US011639839B1

(12) United States Patent
Swensen

(10) Patent No.: US 11,639,839 B1
(45) Date of Patent: May 2, 2023

(54) RIFLE SAFETY STRAP AND SHOOTING AID

(71) Applicant: Michael Swensen, Cedar Hills, UT (US)

(72) Inventor: Michael Swensen, Cedar Hills, UT (US)

( * ) Notice: Subject to any disclaimer, the term of this patent is extended or adjusted under 35 U.S.C. 154(b) by 0 days.

(21) Appl. No.: 17/685,082

(22) Filed: Mar. 2, 2022

(51) Int. Cl.
*F41C 33/00* (2006.01)
*F41C 23/02* (2006.01)

(52) U.S. Cl.
CPC ..... *F41C 33/002* (2013.01); *F41C 23/02* (2013.01)

(58) Field of Classification Search
CPC ..... A45F 3/06; F41C 33/002; F41C 33/001; F41C 33/005; F41C 33/007; F41C 33/046; F41C 23/02
See application file for complete search history.

(56) References Cited

U.S. PATENT DOCUMENTS

| | | | | |
|---|---|---|---|---|
| 9,194,655 | B1 * | 11/2015 | Cha | A45F 3/14 |
| 10,231,533 | B2 * | 3/2019 | Vaughan | A45F 3/06 |
| 2007/0145092 | A1 * | 6/2007 | Eberle | A45F 3/04 224/652 |
| 2017/0153086 | A1 * | 6/2017 | Eberle | F41C 33/002 |
| 2020/0124378 | A1 * | 4/2020 | Baskins | F41C 33/001 |
| 2020/0278174 | A1 * | 9/2020 | Gill | F41H 1/02 |

* cited by examiner

*Primary Examiner* — Corey N Skurdal
(74) *Attorney, Agent, or Firm* — Nelson IP; Daniel P. Nelson

(57) ABSTRACT

A method for protecting a rifle and stabilizing the rifle when shooting is disclosed. In one embodiment, such a method includes providing a strap and connecting a first end of the strap to a backpack. A second end of the strap is connected to a rifle. A length of the strap is adjusted such that when a user pulls the rifle over the shoulder from the backpack and holds the rifle in a shooting position, the strap slides over the user's shoulder from the backpack to the rifle and reduces a weight of the rifle in the user's arms when the rifle is held in the shooting position. In certain embodiments, the length of the strap is adjusted to maintain the rifle substantially level when in the shooting position.

11 Claims, 21 Drawing Sheets

RIFLE SAFETY STRAP AND SHOOTING AID

BACKGROUND

Field of the Invention

This invention relates to systems and methods for carrying rifles or other hunting equipment on backpacks, shoulder harnesses, or the like.

Background of the Invention

Back country game hunting often requires an extensive assortment of gear, not the least of which is a hunting rifle. Assuming the hunter carries much of his or her gear in a backpack, which is most frequently the case, the hunter is often left to carry his or her rifle with a sling that is draped over the shoulder. This may allow the rifle to be quickly retrieved in the event the rifle is needed, such as when game is spotted. However, carrying a rifle in this manner may be unwieldly and cause a hunter significant pain and/or discomfort during long hikes due to the imbalanced or improper weight distribution of the rifle on the shoulders, arms, or other body parts.

To alleviate this problem, a hunter may strap the rifle to a backpack that the hunter then carries on his or her back. Although effective to more evenly and effectively distribute the weight, this technique may unfortunately place the rifle out of the hunter's reach, or at least significantly hinder its accessibility. In some cases, retrieving the rifle may require removing the backpack and unstrapping the rifle before it can be used. By this time, an opportunity may have already passed. Furthermore, because not all backpacks are designed to carry a rifle, a specially designed backpack may be needed to provide this functionality.

SUMMARY

The invention has been developed in response to the present state of the art and, in particular, in response to the problems and needs in the art that have not yet been fully solved by currently available apparatus and methods. Accordingly, apparatus and methods have been developed to more effectively and efficiently carry a rifle or other hunting equipment. The features and advantages of the invention will become more fully apparent from the following description and appended claims, or may be learned by practice of the invention as set forth hereinafter.

Consistent with the foregoing, a method for protecting a rifle and stabilizing the rifle when shooting is disclosed. In one embodiment, such a method includes providing a strap and connecting a first end of the strap to a backpack. A second end of the strap is connected to a rifle. A length of the strap is adjusted such that when a user pulls the rifle over the shoulder from the backpack and holds the rifle in a shooting position, the strap slides over the user's shoulder from the backpack to the rifle, and reduces a weight of the rifle in the user's arms when the rifle is held in the shooting position. In certain embodiments, the length of the strap is adjusted to maintain the rifle substantially level when in the shooting position.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the embodiments of the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
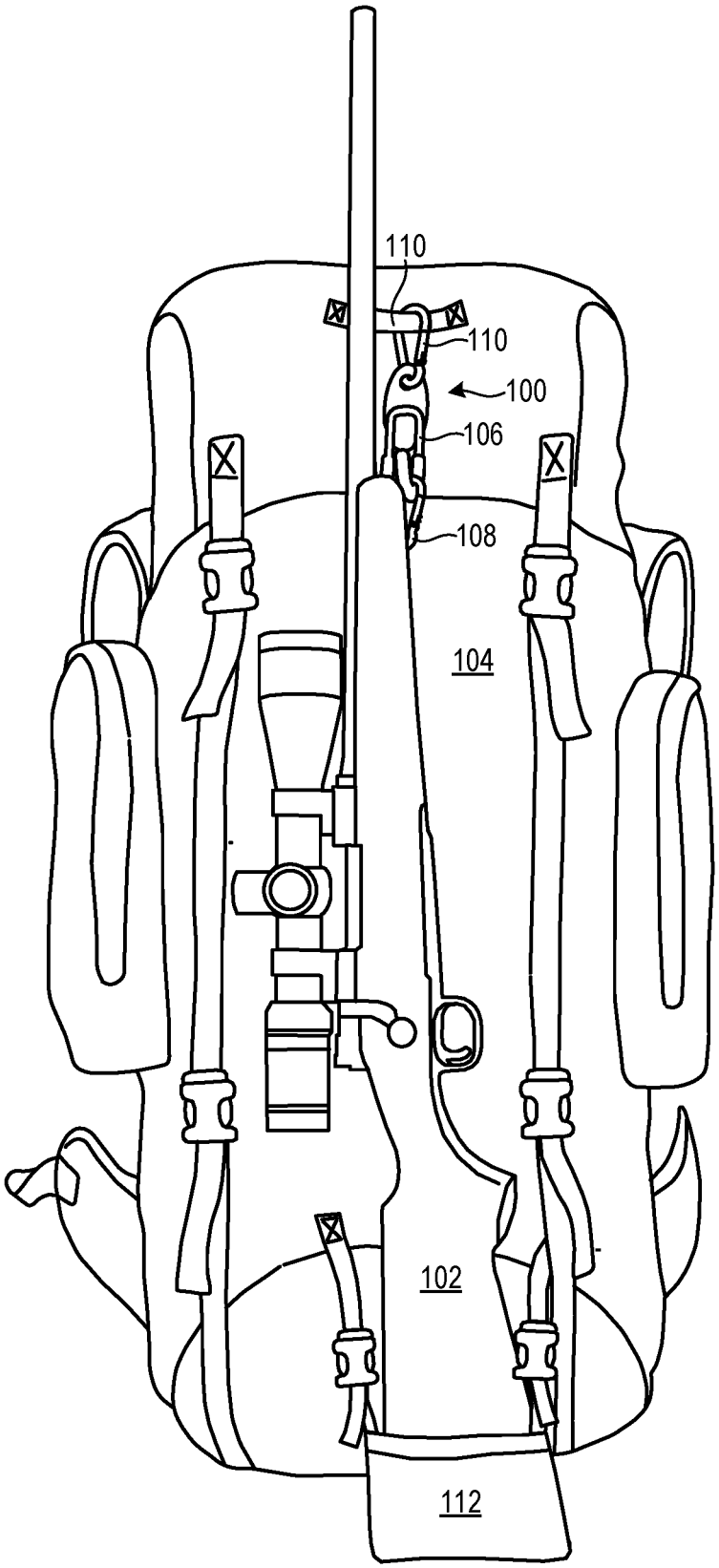
FIG. 1 is a perspective view showing one example of an apparatus for carrying a rifle on a backpack.

Referring to FIG. 1, one example of an apparatus 100 for carrying a rifle 102 or other hunting equipment (e.g., bow, binoculars, etc.) is illustrated. As previously mentioned, game hunting may require an extensive assortment of gear, not the least of which is a hunting rifle 102. Assuming a hunter carries much of his or her gear in a backpack 104, the hunter may be left to carry his or her rifle 102 with a sling that is draped over the shoulder. This may allow the rifle 102 to be quickly retrieved in the event the rifle 102 is needed, such as when game is spotted. However, carrying a rifle 102 in this manner may be unwieldly and cause a hunter significant pain and/or discomfort during long hikes due to imbalanced or improper weight distribution of the rifle 102 on the shoulders, arms, or other body parts.

To alleviate this problem, a hunter may strap the rifle 102 to a backpack 104 that the hunter then carries on his or her back. Although effective to more evenly and effectively distribute the weight, this technique unfortunately may place the rifle 102 out of the hunter's reach or may significantly hinder its accessibility. In some cases, retrieving the rifle 102 may require removing the backpack 104 and unstrapping the rifle 102 before it can be used. By this time, an opportunity may have already passed. Furthermore, because not all backpacks 104 are designed to carry a rifle, a specially designed backpack 104 may be needed to provide this functionality.

To address the issues identified above, in certain embodiments, an apparatus 100 for carrying a rifle 102 may be provided that is universal to various types of backpacks 104. In certain embodiments, the apparatus 100 includes a hook 106 that is configured to engage a loop 108 (e.g., a metal ring, strap, etc.) that is attached to the rifle 102. An attachment mechanism 110 may be coupled to the hook 106 to attach the hook 106 to the backpack 104. In certain embodiments, the attachment mechanism 110 is embodied as a closeable ring (e.g., a carabiner) or as a strap that may be cinched down on some part of the backpack 104, such as on a handle 110 or frame of the backpack 104. In certain embodiments, a sheath 112 may be provided to support a bottom of the rifle 102 while it is being carried on the backpack 104.

The apparatus 100 may free the hands of a user and substantially center the weight of the rifle 102 on the user's back, thereby eliminating or reducing strain and discomfort in the user's shoulders or other body parts. Advantageously, the apparatus 100 may enable the user to easily retrieve the rifle 102 by reaching over his or her back and pulling up on the rifle 102. Because of the hook 106 and loop 108 design of the apparatus 100, the rifle 102 will easily release from the apparatus 100 (i.e., the loop 108 will release from the hook 106). This may enable the rifle 102 to be retrieved quickly, which may be advantageous in instances where game is spotted. The universal design of the apparatus 100 enables the apparatus 100 to be used with a wide variety of backpacks 104 or shoulder harnesses.

Figure 2:
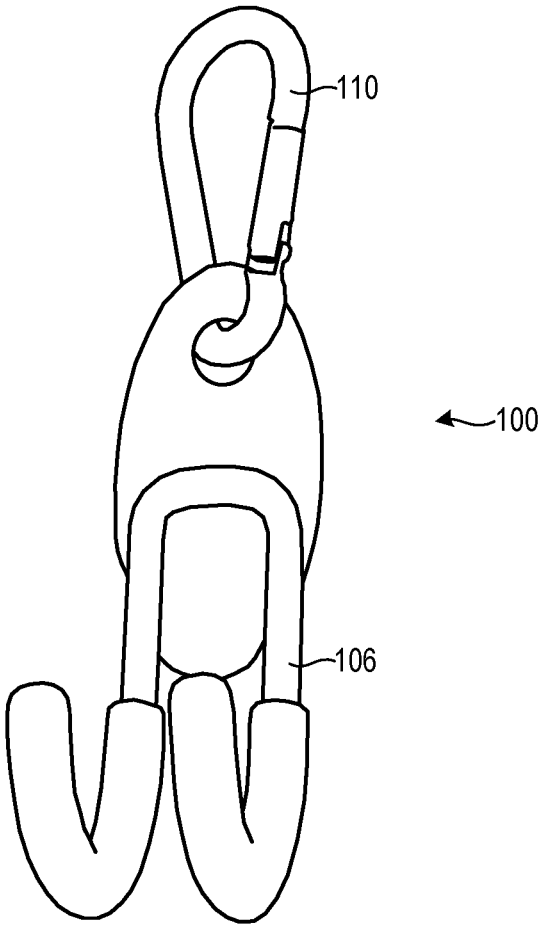
FIG. 2 is a perspective view showing a more closeup view of the apparatus of FIG. 1.

Referring to FIG. 2, a more closeup view of the apparatus of FIG. 1 is illustrated. In the illustrated embodiment, the attachment mechanism 110 is a ring although the ring could be replaced with a strap, such as a cinchable strap that may snuggly hold some feature of a backpack 104. The illustrated embodiment shows a double hook design 106, although a single hook 106 may be used in other embodiments. Although a distance between the hook 106 and the attachment mechanism 110 is substantially fixed in the illustrated embodiment, in other embodiments the distance may be modified with an adjustable strap or slider. This may allow the user to adjust the height of the rifle 102 on the user's back, thereby facilitating retrieval of the rifle 102 and/or reducing the chance that the rifle 102 will catch on branches or other objects while the user is walking.

Figure 3:
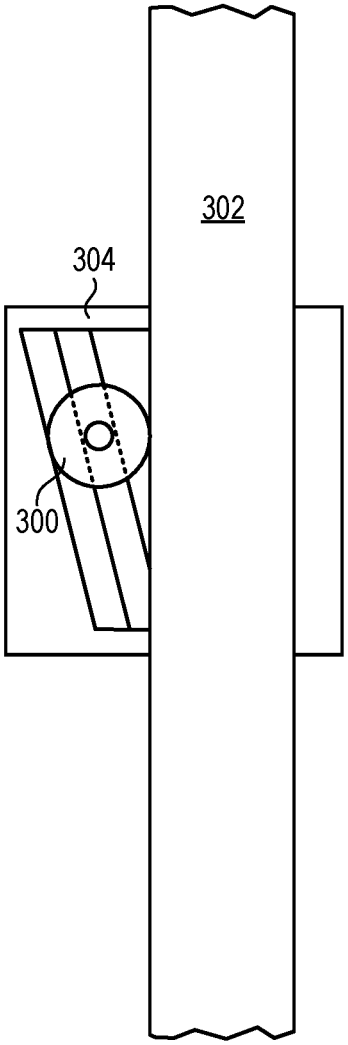
FIG. 3 is a front view showing an alternative mechanism for holding or gripping a rifle.

The hook 106 and loop 108 design illustrated in FIGS. 1 and 2 may be considered one type of "coupling mechanism" for connecting a rifle 102 to the apparatus 100. In other embodiments, the "coupling mechanism" includes other types of devices that are capable of holding and/or gripping a rifle 102. For example, in certain embodiments, the coupling mechanism includes a gripping element 304 comprising a wheel 300 (or wheels 300) that grip the side(s) of a rifle's barrel 302 (or other part of the rifle 102) when gravity pulls the rifle 102 in a downward direction, as shown in FIG. 3. The wheel 300 or wheels 300 may be made of or coated with a tacky or grippy material to grip the barrel 302. Pulling the rifle 102 in an upward direction (as might occur when the user reaches over his or her shoulder to grab the rifle 102) may release the rifle 102 from the grip of the wheel 300 or wheels 300, thereby allowing the rifle 102 to be released from the apparatus 100.

Figure 4A:
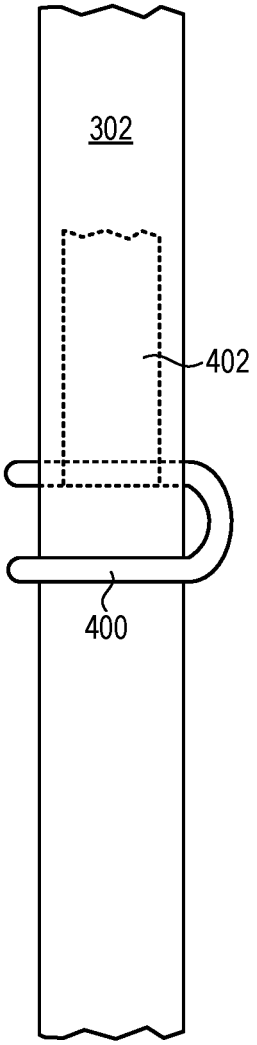
FIG. 4A is a front view showing another alternative mechanism for holding or gripping a rifle.
Figure 4B:
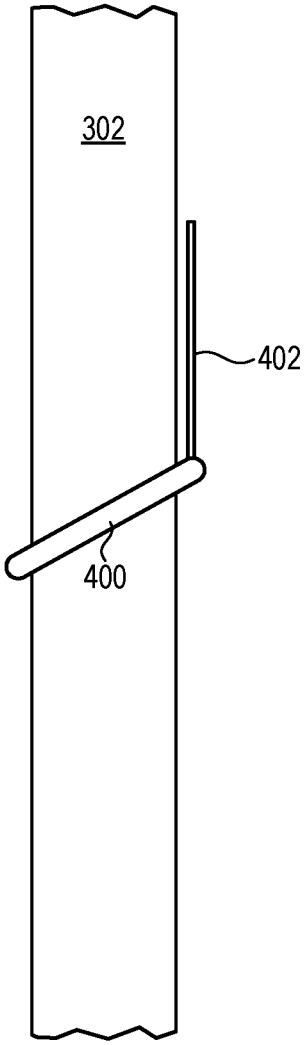
FIG. 4B is a side view of the alternative mechanism illustrated in FIG. 4A.

In other embodiments, the coupling mechanism includes a gripping element 400 that grips a barrel 302 or other part of the rifle 102 as the gripping element 400 rotates relative to the rifle 102. A strap 402 or other element may couple the gripping element 400 to the backpack 104. The gripping element 400 may also be made of or coated with a tacky or grippy material that grips the barrel 302. Pulling the rifle 102 in an upward direction may rotate the gripping element 400 and release the rifle 102. FIG. 4A shows a front view of the gripping element 400 and FIG. 4B shows a side view of the gripping element 400 relative to the barrel 302. FIGS. 3, 4A, and 4B are simply examples of different mechanisms for coupling a rifle 102 to the apparatus 100 and are not intended to represent an exhaustive list of such mechanisms.

Figure 5:
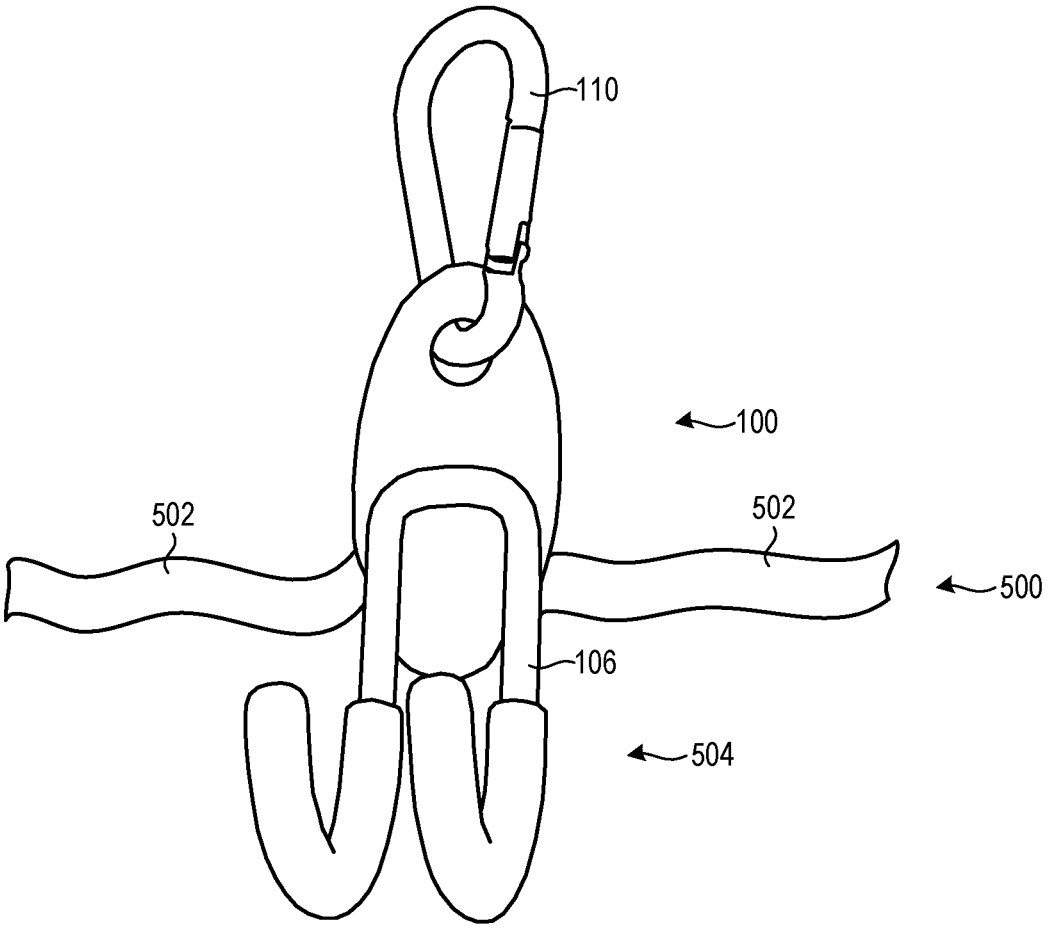
FIG. 5 is a perspective view showing one example of an anti-drift mechanism incorporated into the apparatus of FIG. 2.

Referring to FIG. 5, in certain situations, the coupling mechanism 504 of the apparatus 100 may have a tendency to move or drift laterally with respect to a backpack 104, such as when a user is walking, bending over, or the like. In other cases, a shape or fullness of the backpack 104 may cause the apparatus 100 to drift to one side of the backpack 104 or the other. This may be undesirable in that it may cause the rifle 102 to deviate from a centered position on the backpack 104.

To address this concern, in certain embodiments, an anti-drift mechanism 500 may be incorporated into the apparatus 100. This anti-drift mechanism 500 may take on various different forms. For example, the anti-drift mechanism 500 may be as simple as a pair of straps 502 (as shown) that can be tied, snapped, hook-and-loop fastened, clipped, or otherwise attached to a backpack 104 to prevent the apparatus 100 from drifting to one side or the other. In other embodiments, the anti-drift mechanism 500 incorporates an anti-slip surface (e.g., a rubber surface) placed on the back of the apparatus 100 to keep the apparatus 100 from drifting to one side or the other. In other embodiments, the anti-drift mechanism 500 is a pin or hook-and-loop fastener on the back of the apparatus 100 that is configured to couple the apparatus 100 to the backpack 104. In yet other embodiments, the anti-drift mechanism 500 is an elastic cord (e.g., a bungee cord) that is looped around a bottom of the backpack 104 to keep the apparatus 100 substantially centered on the backpack 104 and keep it from drifting to one side or the other. In certain embodiments, the length of the elastic cord may be adjustable.

Figure 6A:
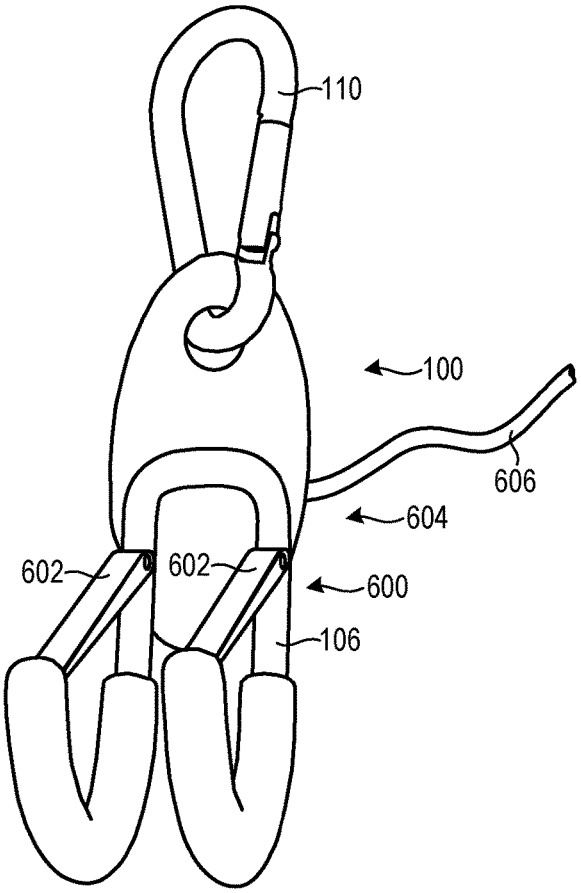
FIG. 6A is a perspective view showing one example of a retention mechanism incorporated into the apparatus, wherein the retention mechanism is in a closed position.
Figure 6B:
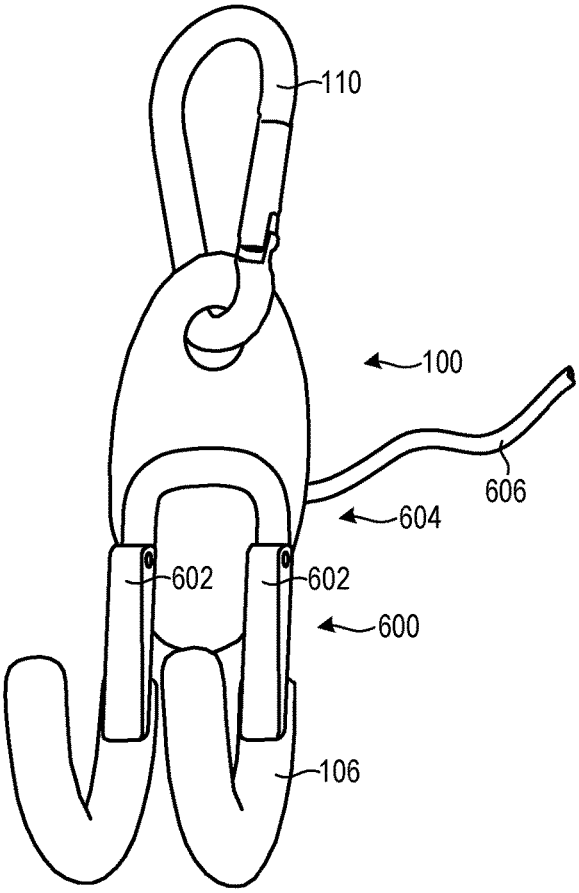
FIG. 6B is a perspective view showing the retention mechanism of FIG. 6A in an open position.

Referring to FIGS. 6A and 6B, in certain embodiments, particularly where a hook 106 is used with the apparatus 100, a retention mechanism 600 may be provided to retain the loop 108 within the hook 106. This will ensure that the loop 108 does not slip out of the hook 106 while the user is hiking, climbing, bending over, etc. In the illustrated embodiment, the retention mechanism 600 is embodied as a pair of retention members 602 that, when in a closed position, create a closed loop with the hooks 106. FIG. 6A shows the retention members 602 in a closed position. To release the loop 108 from the hook 106, the retention members 602 may be placed in an open position, as shown in FIG. 6B. This may enable a user to remove a rifle 102 from the apparatus 100. When using a single hook 106 with the apparatus 100 (as opposed to the dual hooks 106 shown in FIGS. 6A and 6B), a single retention member 602 may be used.

Figure 7:
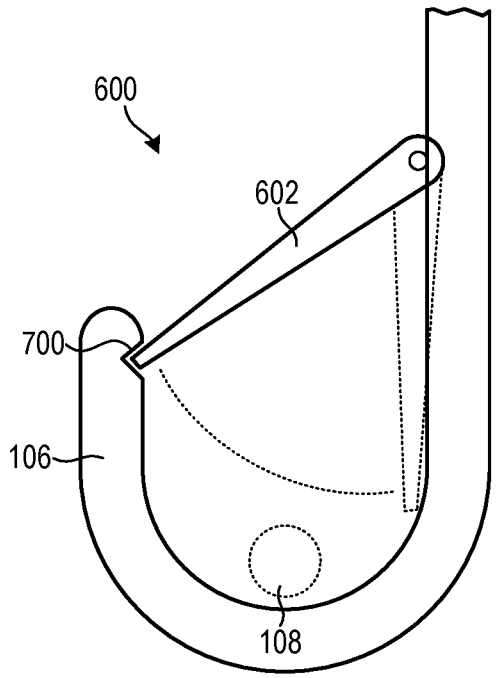
FIG. 7 is a side profile view showing exemplary operation of the retention mechanism of FIGS. 6A and 6B.

FIG. 7 shows an example of an apparatus 100 that includes a retention mechanism 600 comprising at least one retention member 602 that moves between an open and closed position. In certain embodiments, the retention member 602 is spring loaded such that the retention member 602 is normally in the closed position (as shown). In certain embodiments, when in the closed position, the retention member 602 may rest against a surface 700 or notch 700 in the hook 106. To couple a rifle 102 to the apparatus 100, a loop 108 on the rifle 102 may be pressed against the retention member 602 to cause the retention member 602 to deflect downward and thereby enable the loop 108 to enter the hook 106. The retention member 602 may then spring back into the closed position. Because the retention member 602 rests against the surface 700 or notch 700, the loop 108 will be unable to exit the hook 106 even if the loop 108 is pressed against the retention member 602. In essence, the loop 108 is locked inside the closed ring formed by the hook 106 and the retention member 602.

Figure 8:
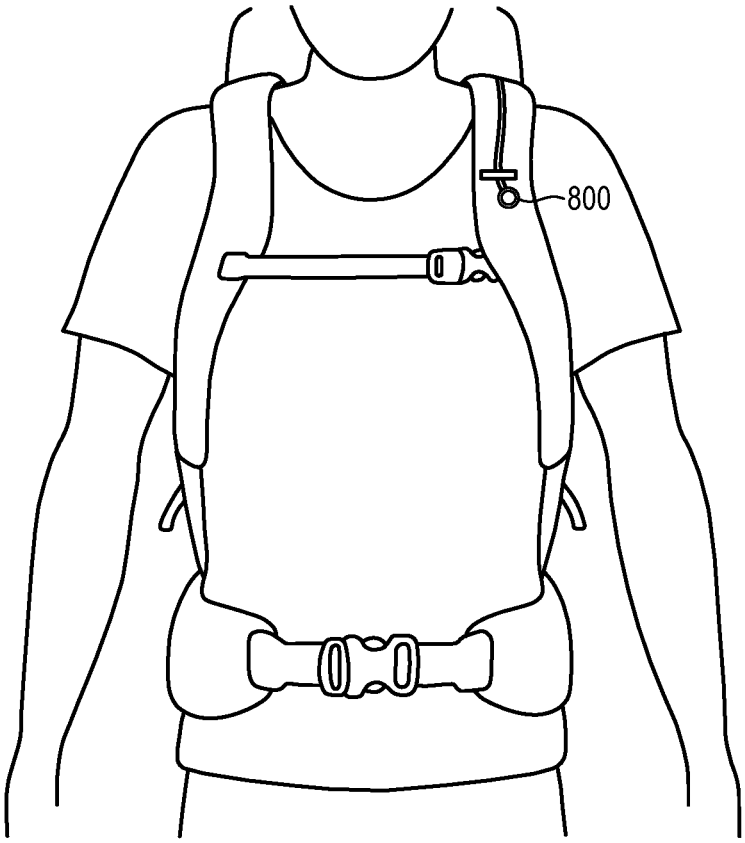
FIG. 8 is a front view showing a release mechanism that is accessible from a front of a backpack.

To release the loop 108 from the hook 106, a release mechanism 604 may be used to move the retention member 602 from the closed position to an open position (as shown by the dotted line). As shown in FIGS. 6A and 6B, in certain embodiments, the release mechanism 604 includes a cable 606 to move the retention member 602 from the closed position to the open position. This cable 606 may in certain embodiments be actuated by the user from a front of the backpack 104, as shown in FIG. 8, using a pull cord 800, switch, lever, button, or the like. This may allow the user to actuate the retention member 602 and thereby release the rifle 102 from the apparatus 100. This design may have an added benefit of securing the user's rifle 102 within the apparatus 100 until the user is ready to retrieve the rifle 102. This may also prevent others from gaining control of the rifle 102.

In other embodiments, instead of using a cable 606, the release mechanism 604 may be actuated electronically using a wired or even wireless connection (e.g., a Bluetooth connection). For example, a wired or wireless connection may be used to cause the release mechanism 604 to open the retention member 602. Such an embodiment may, in certain cases, utilize a battery, motor, and communication circuitry on the apparatus 100. Other techniques and mechanisms for controlling the release mechanism 604 may be used and are within the scope of the invention.

The retention mechanism 600 shown in FIG. 7 simply shows one example of a mechanism that may be used to secure a rifle 102 to the apparatus 100. Other mechanisms are possible and within the scope of the invention. When using any of the alternative embodiments illustrated in FIGS. 3, 4A, and 4B, other types of retention mechanisms 600 may be used.

It should be recognized that while the apparatus 100 disclosed in FIGS. 1-8 may be universally used with many different types of backpacks 104, an apparatus 100 may also be incorporated into a backpack 104 or other shoulder harness. For example, one or more of a hook 106 (or the disclosed alternatives), retention mechanism 600, release mechanism 604, and the like, may be incorporated into a backpack 104. Similarly, although the apparatus 100 has been disclosed primarily for carrying rifles, the apparatus 100 may also be used to carry bows and other hunting equipment.

Figure 9:
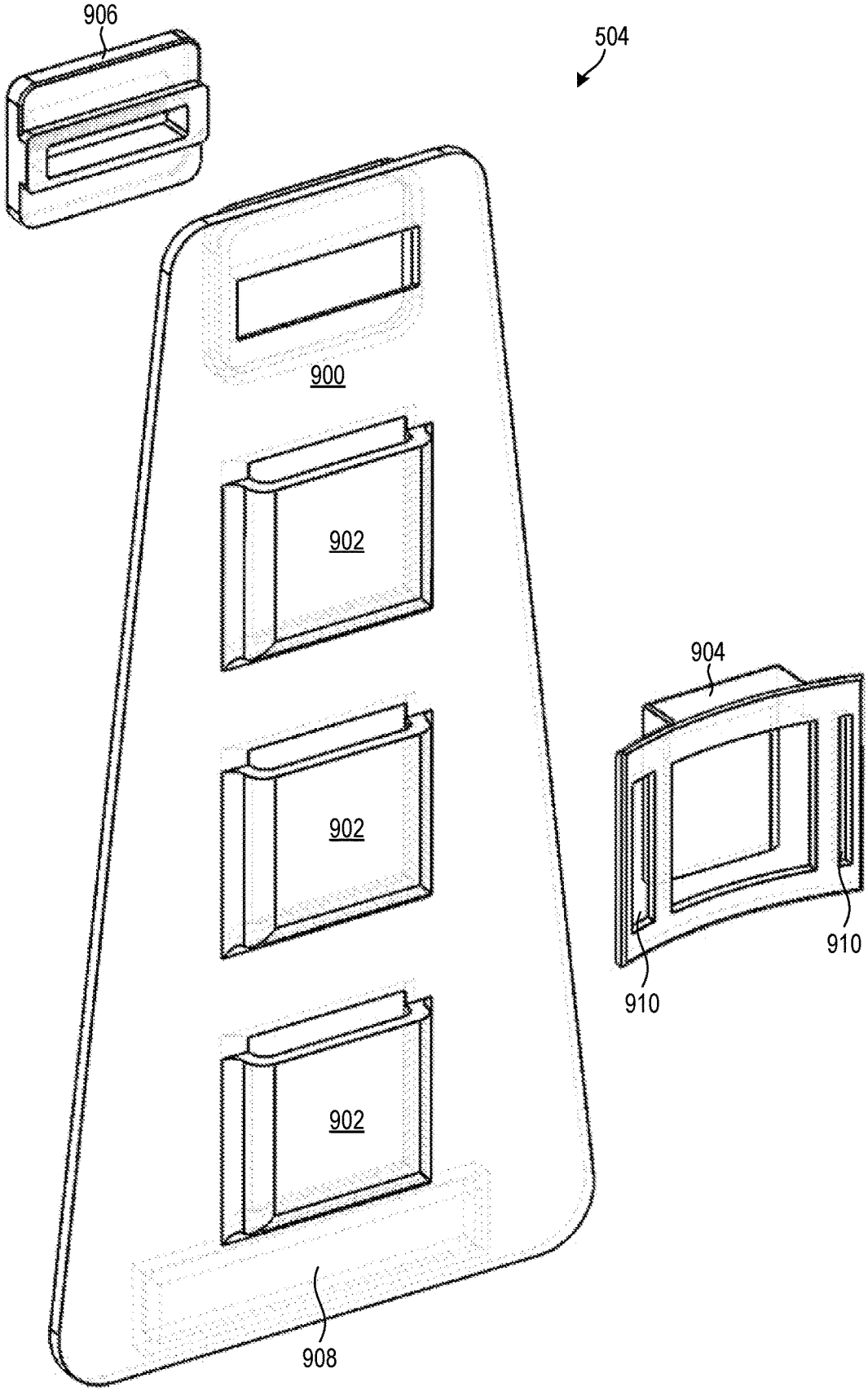
FIG. 9 is a perspective view of an alternative embodiment of an apparatus for carrying a rifle on a backpack.
Figure 10:
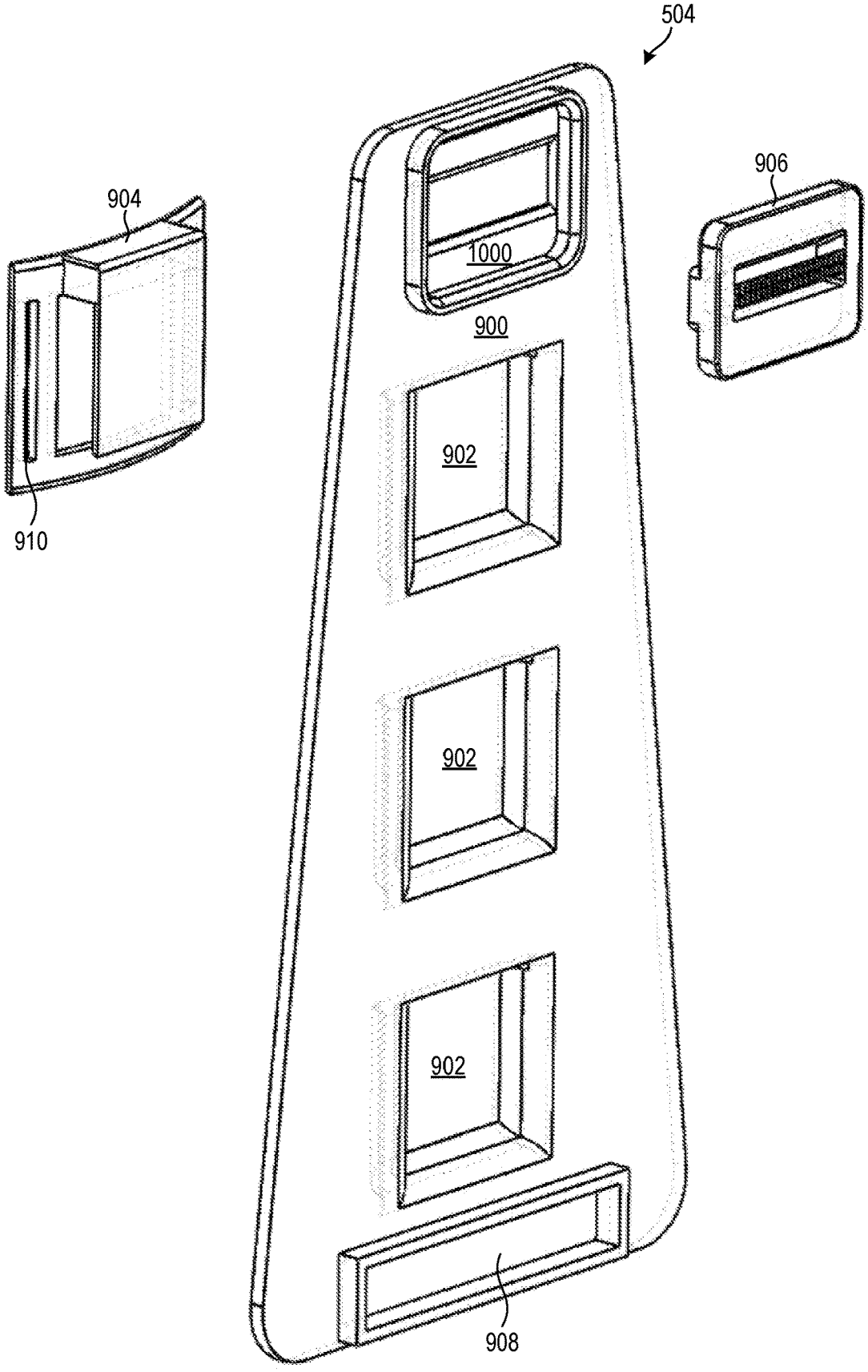
FIG. 10 is a reverse perspective view of the apparatus of FIG. 9.
Figure 12:
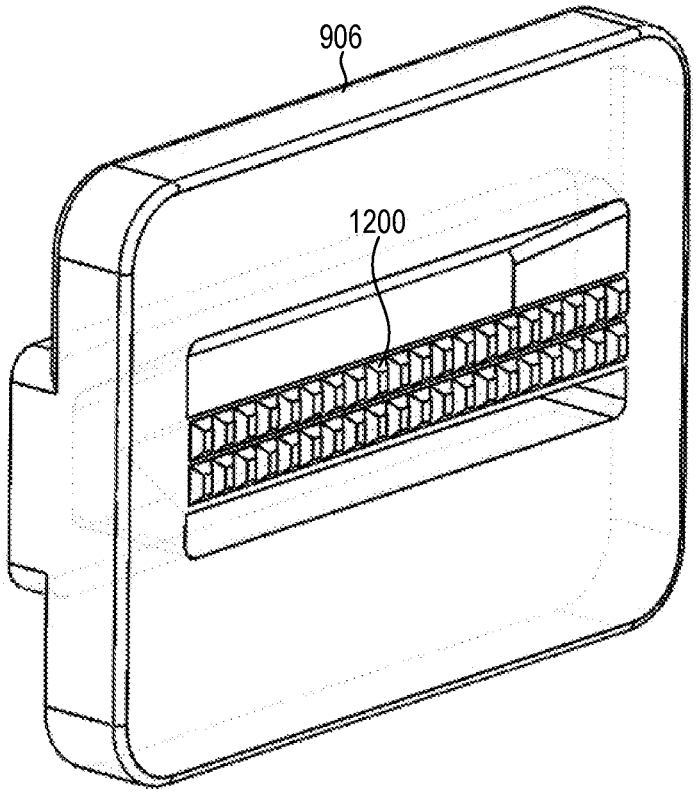
FIG. 12 is a perspective view of one embodiment of a cinching device for use with the apparatus of FIG. 9.

Referring to FIGS. 9 and 10, an alternative embodiment of an apparatus 100 for carrying a rifle 102 on a backpack 104 is illustrated. In this example, the coupling mechanism includes a plate 900 comprising multiple loops 902 arranged at various heights on the plate 900. This plate 900 may be attached to a backpack 104. For example, a cinching device 906 may engage a flexible strap (not shown) that may in turn be connected to the backpack 104, such as looped over some feature of the backpack 104, such as a handle or frame. The cinching device 906 may be slid along the strap and engage an aperture 1000 in the plate 900 and thereby allow the plate 900 to hang from the backpack 104. This is similar to the coupling mechanism 504 illustrated in FIG. 1. The strap may be adjusted in the cinching device 906 to adjust the height of the plate 900 relative to the backpack 104. FIG. 12 shoes a larger view of the cinching device 906, and more particularly a central member 1200 around which a strap may be routed.

In certain embodiments, the plate 900 includes a magnet 908. This magnet 908 may draw the plate 900 to some metallic component or member of the backpack 104, such as a piece of metal that is placed inside the backpack 104. The magnet 908 and metal piece together may grip the backpack 104 and prevent or reduce swinging of the plate 900 with respect to the backpack 104.

Figure 11A:
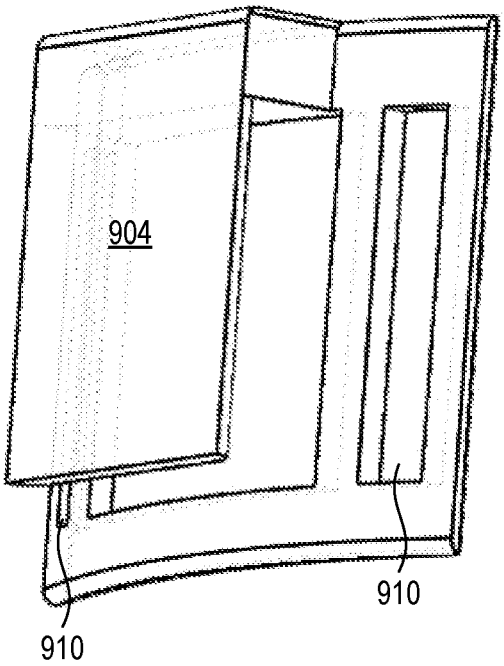
FIGS. 11A and 11B are perspective views of a hook used with the apparatus of FIG. 9.
Figure 11B:
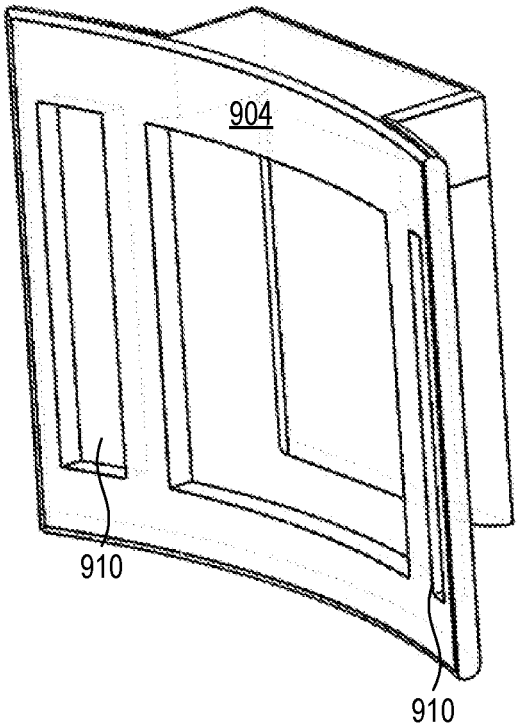

The illustrated hook 904 may slide into any of the loops 902 on the plate 900. The hook 904 may be coupled to a rifle 102 with a strap that is routed through or looped around apertures 910 incorporated into the hook 904. In certain embodiments, the hook 904 and accompanying strap (not shown) is placed below a sling mount on the rifle 102 to keep the hook 904 from sliding with respect to the rifle 102. Once the hook 904 is coupled to the rifle 102, the hook 904 may be placed into one of the loops 902 of the plate 900 depending on a desired height of the rifle 102 relative to the backpack 104. This may allow the rifle 102 to hang from the backpack 104 at a desired height, while allowing the rifle 102 to be quickly released from the backpack 104 when needed. For example, when the rifle 102 is needed, a user may reach over his or her shoulder and pull the rifle 102 upward. This may release the hook 904 from the loop 902, thereby allowing the rifle 102 to be retrieved. FIGS. 11A and 11B show various alternative views of the hook 904.

Like the previous embodiment of the coupling mechanism 504, in certain embodiments, a retention mechanism 600 (e.g., locking element) may be incorporated into the coupling mechanism 504 to keep the hook 904 retained within the loop 902 until a user wishes to remove the rifle 102 from the coupling mechanism 504. The retention mechanism 600 may be released by a release mechanism 604 such as a cable. In certain embodiments, this cable 606 may be actuated by the user from a front of the backpack 104, as shown in FIG. 8, using a pull cord 800, switch, lever, button, or the like.

Figure 13:
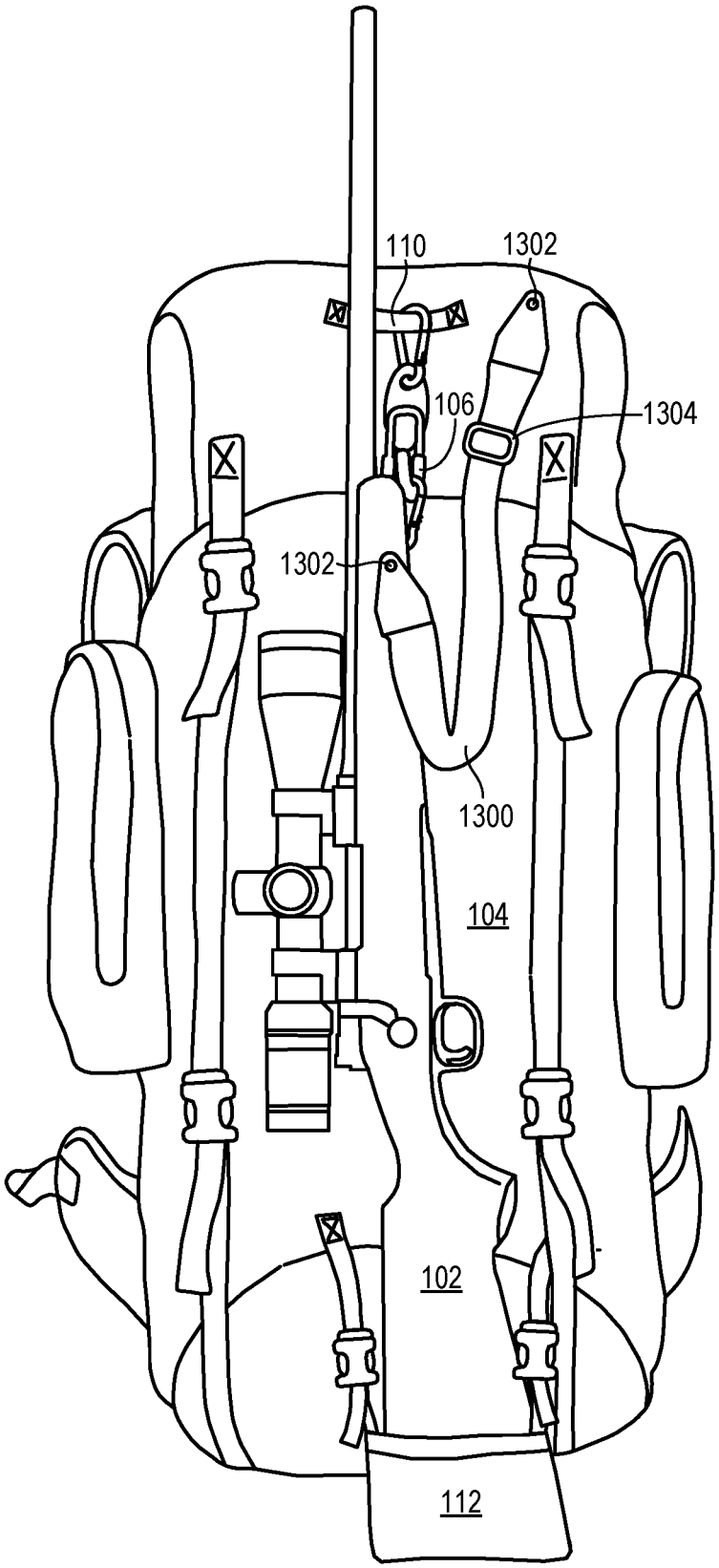
FIG. 13 is a perspective view of one embodiment of a safety strap and shooting aid in accordance with the invention.

Referring to FIG. 13, in certain embodiments, when a rifle 102 is carried on a backpack 104, a safety strap and shooting aid 1300 may be provided to protect the rifle 102. For example, if the rifle 102 were to disengage (e.g., come unhooked) from the coupling mechanism 504 while a user is hiking, the safety strap and shooting aid 1300 may catch the rifle 102 to prevent it from falling to the ground and becoming damaged. In the illustrated embodiment, the safety strap and shooting aid 1300 are shown with very rudimentary and generic connections 1302 to the rifle 102 and backpack 104 respectively. In certain embodiments, these connections 1302 may be clips that removably couple the safety strap and shooting aid 1300 to the rifle 102 and backpack 104 respectively. Although the safety strap and shooting aid 1300 are shown on one side of the rifle 102 and backpack 104, the safety strap and shooting aid 1300 may also be utilized on the other side of the rifle 102 and backpack 104 depending on whether the rifle is left-handed or right-handed.

In certain embodiments, the length of the safety strap and shooting aid 1300 is adjustable. For example, a slide 1304 may be provided on the safety strap and shooting aid 1300 to adjust its length. In certain embodiments, the length of the safety strap and shooting aid 1300 is adjusted to assist a user in shooting the rifle 102, as will be explained in more detail hereafter.

Figure 14:
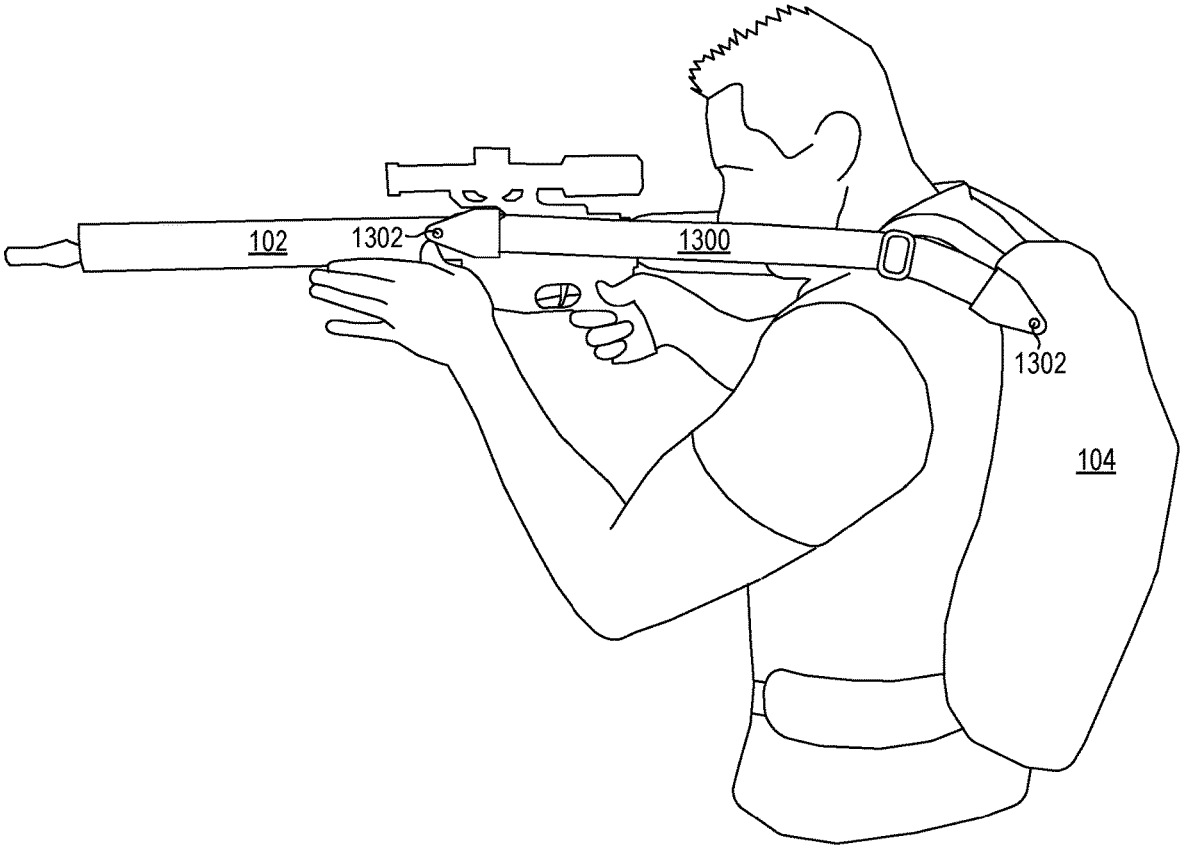
FIG. 14 shows the safety strap and shooting aid of FIG. 13 in use.

Referring to FIG. 14, while continuing to refer generally to FIG. 13, in practice, when a user wishes to use the rifle 102, the user may reach over his or her shoulder and remove the rifle 102 from the coupling mechanism 504. As the rifle 102 is brought over the shoulder into the shooting position, the safety strap and shooting aid 1300 may become taught and/or stretch between its attachment point 1302 on the backpack 104 and the attachment point 1302 on the rifle 102. This may pull the rifle 102 into the user's shoulder to keep the rifle 102 tight and secure in the shooting position. A hip or waist belt and shoulder straps of the backpack 104 may keep the backpack 104 in place even with the tension in the safety strap and shooting aid 1300.

Because the safety strap and shooting aid 1300 is routed over the user's shoulder, this may also create an upward pull on the rifle 102 to reduce the weight of the rifle 102 in the user's hands. This may decrease fatigue and steady the rifle 102 in the user's hands, thereby assisting the user in shooting the rifle 102 and ideally improving the user's accuracy and endurance when holding the rifle 102. Although not clearly visible in FIG. 14, the safety strap and shooting aid 1300 may triangulate with the rifle 102 and user to create vector forces that lift the rifle and thereby reduce the weight of the rifle 102 in the user's hands (by pulling upward), as well as pull the rifle 102 into the user's shoulder.

Figure 15:
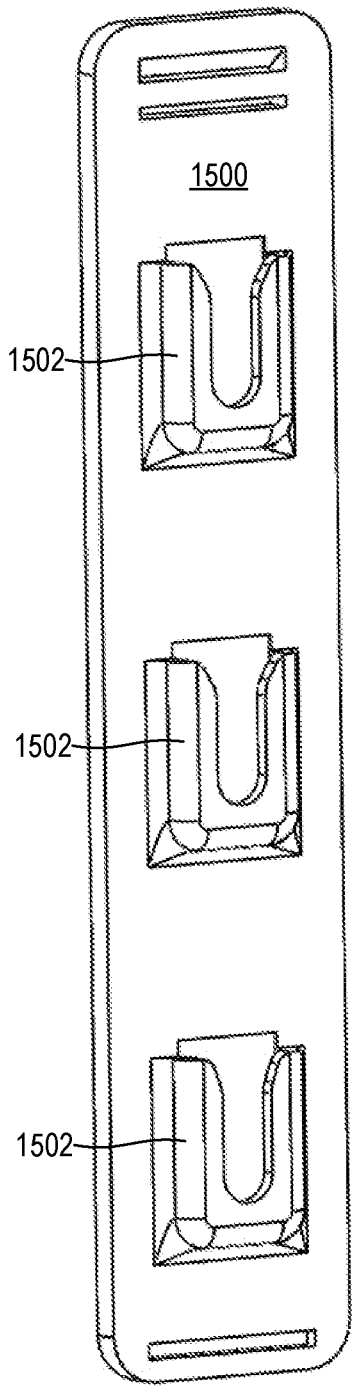
FIG. 15 is a perspective view of another alternative embodiment of an apparatus for carrying a rifle on a backpack.

Referring to FIG. 15, another alternative embodiment of an apparatus for carrying a rifle on a backpack 104 is illustrated. In this example, a coupling mechanism includes a plate 1500 comprising key slots 1502 arranged at various heights on the plate 1500. This plate 1500 may be attached to a backpack 104 with a strap or other means, as will be discussed in association with FIG. 18. In certain embodiments, the plate 1500 is positioned to hang substantially centrally on the back of a backpack 104.

Figure 16:
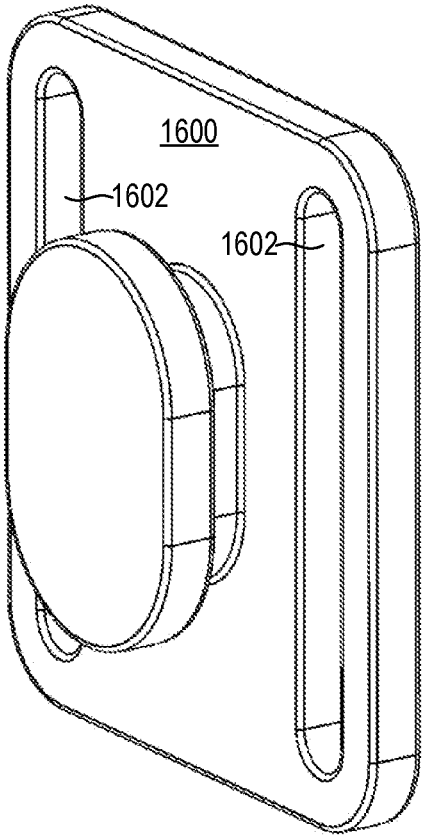
FIG. 16 is a perspective view of a key used with the apparatus of FIG. 15.
Figure 17:
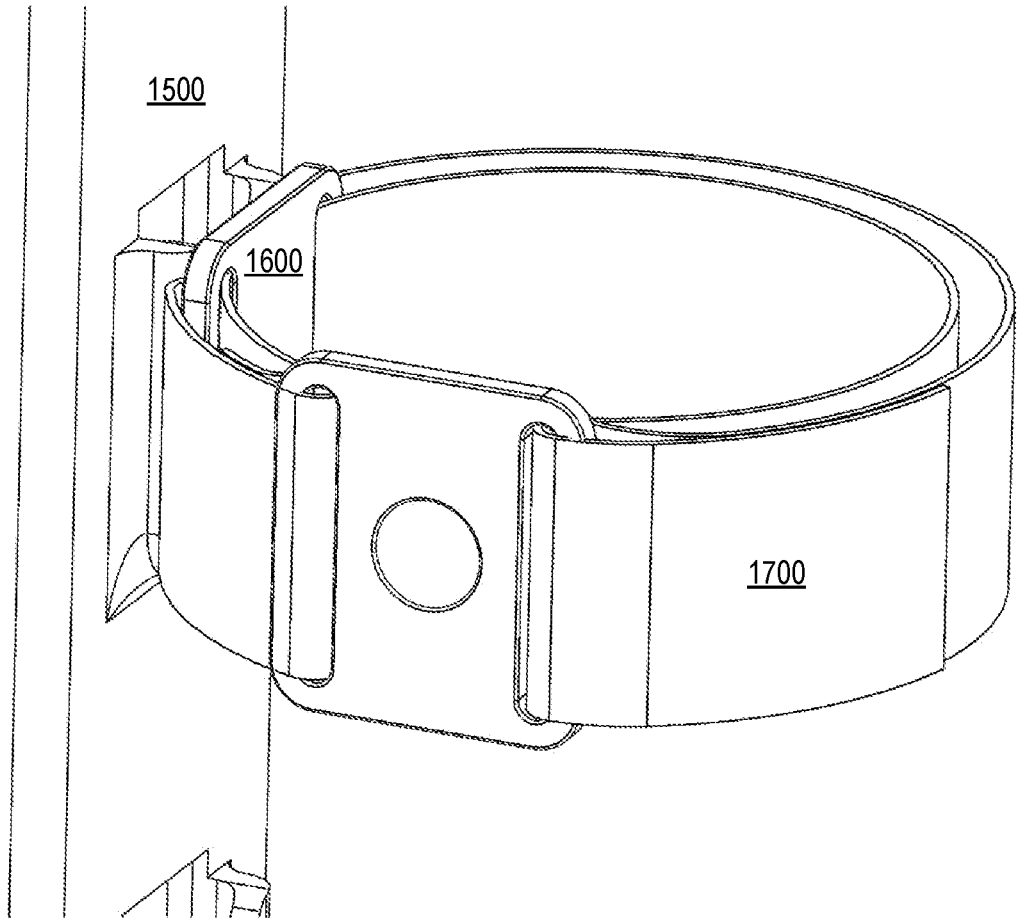
FIG. 17 is a perspective view of one embodiment of a cinching device for use with the apparatus of FIGS. 15 and 16.

Referring to FIGS. 16 and 17, in certain embodiments, a key 1600 is configured to slide into any of the key slots 1502 on the plate 1500. This key 1600 may be coupled to a rifle 102 with a strap 1700 that is routed through or looped around apertures 1602 that are incorporated into the key 1600. In certain embodiments, the key 1600 and accompanying strap 1700 are placed below a sling mount on the rifle 102 to keep the key 1600 from sliding off of the rifle 102. In certain embodiments, the strap 1700 is secured to the rifle using velcro (i.e., hook and loop) or using some cinching mechanism.

Once the key 1600 is coupled to the rifle 102, the key 1600 may be placed into one of the key slots 1502 of the plate 1500, depending on a desired height of the rifle 102 relative to the backpack 104. This may allow the rifle 102 to hang from the backpack 104 at a desired height, while allowing the rifle 102 to be quickly released from the backpack 104 when needed. For example, when the rifle 102 is needed, a user may reach over his or her shoulder and pull the rifle 102 upward. This may cause the key 1600 to slide upward and out of the key slot 1502, thereby allowing the rifle 102 to be retrieved.

Figure 18:
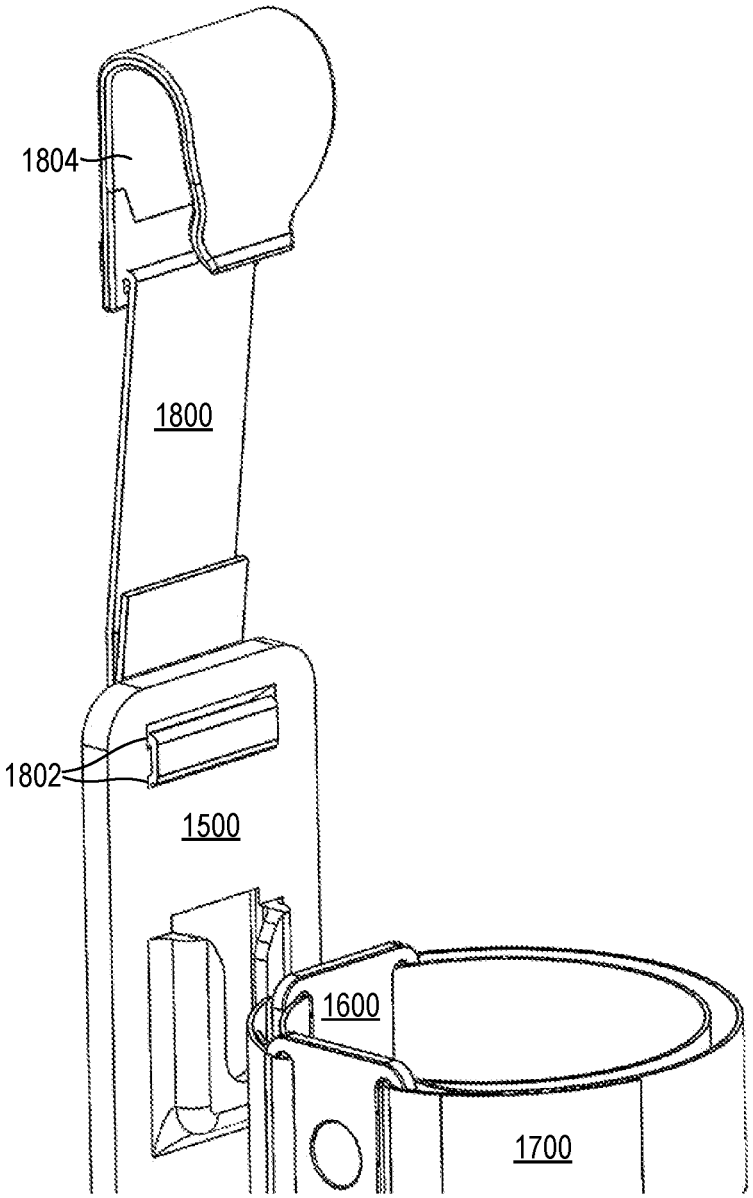
FIG. 18 is a perspective view of one embodiment of a strap for coupling the apparatus of FIGS. 15 and 16 to a backpack.

Referring to FIG. 18, as shown, in certain embodiments, a strap 1800 may be used to couple the plate 1500 to a backpack 104. In this embodiment, the strap 1800 engages slots 1802 in the plate 1500. The strap 1800 may be adjusted within the slots 1802 to modify a length of the strap 1800 that extends from the plate 1500. A hook 1804 or other device may be coupled to an opposite end of the strap 1800 to connect the strap 1800 to a backpack 104, such as a handle or frame of the backpack 104.

Figure 19:
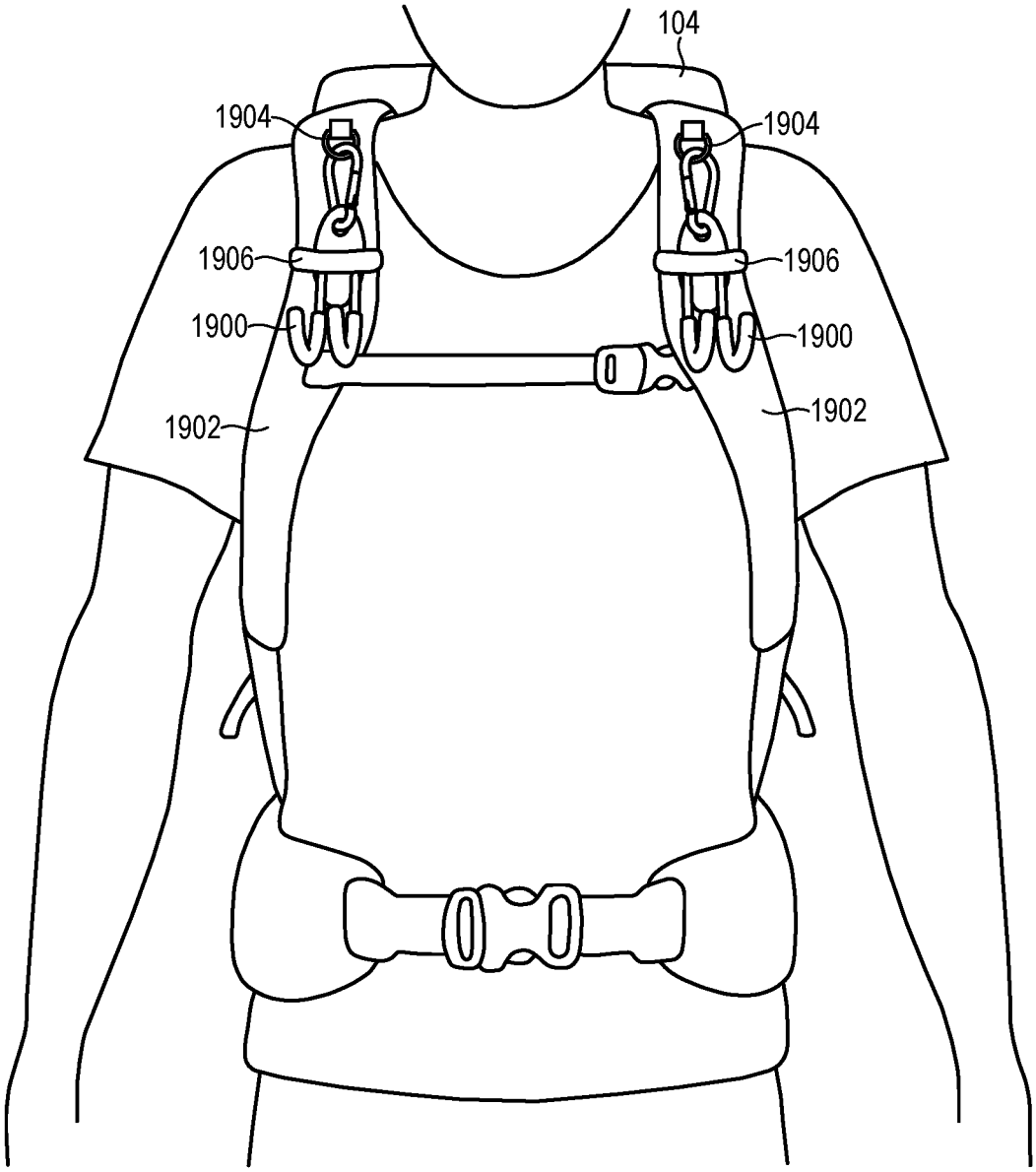
FIG. 19 shows various hooks incorporated into shoulder straps of a backpack in order to free a user's hands and provide a counterbalance for weight of a backpack.

Referring to FIG. 19, in certain embodiments in accordance with the invention, it may be advantageous to provide apparatus and methods to attach items to a front of a backpack 104 to counterbalance weight of the backpack 104 and to free a user's hands when using the backpack 104. Ideally, such apparatus and methods would be able to carry different types of cargo of various shapes and sizes.

In order to accomplish this, in certain embodiments, hooks 1900 for carrying cargo may be incorporated into shoulder straps 1902 of the backpack 104. As shown in FIG. 19, in certain embodiments, such hooks may take the form of that discussed in association with FIGS. 1 and 2. That is, the hooks 1900 may be universally designed to connect to different types of backpacks 104 and shoulder straps. In the illustrated embodiment, the hooks 1900 attach to loops 1904 or other components on the shoulder straps 1902 of the backpack 104. In certain embodiments, the hooks 1900 are secured to the shoulder straps 1902 with a coupling mechanism 1906 (e.g., a strap 1906) that reaches all or partly around the shoulder straps 1902. These straps 1906 may keep the hooks 1900 substantially centered on the shoulder straps 1902 and/or reduce drifting of the hooks 1900 with respect to the shoulder straps 1902. Other coupling mechanisms, such as clips or pins may be used to couple the hooks 1900 to the front or back of the shoulder straps 1902 and keep the hooks 1900 centered and/or prevent the hooks 1900 from swaying relative to the shoulder straps 1902.

In certain embodiments, the hooks 1900 are foldable to get them out of a user's way when not in use, or to lock an item into the hooks 1900. In certain embodiments, the hooks 1900 fold upward. In other embodiments, the hooks 1900 fold to the side. The foldability of the hooks 1900 may enable a user to bring an object such as a gun stock against the user's shoulder without interfering with the hooks 1900.

In order to make the hooks 1900 foldable, one or more hinges may be integrated into the hooks 1900. In certain embodiments, the hinges may be spring-loaded such that the hooks 1900 remain in a folded position until the hooks 1900 are pulled down and utilized. In other embodiments, the hinges are friction hinges that cause the hooks 1900 to stay in the position they are placed by a user. In yet other embodiments, the hooks 1900 are folded upward and snapped in place when they are not needed. When needed, they may be folded down and utilized.

The hooks 1900 shown in FIG. 19 may universally attach to different types of backpacks 104. The way in which the hooks 1900 attach to the backpack 104 may depend on the attachment points provided by the backpack 104, and more particularly the shoulder straps 1902. In other embodiments, the hooks 1900 are integrated into the shoulder straps 1902 of the backpack 104 such that they are part of the design of the backpack 104.

Figure 20:
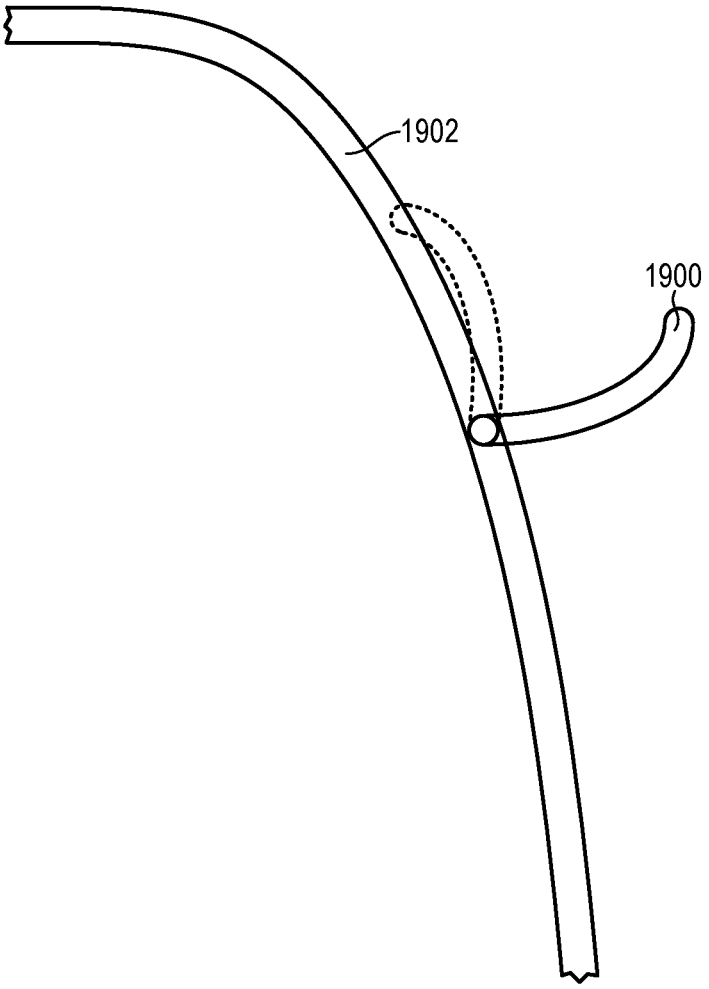
FIG. 20 is a side view showing another embodiment of a hook incorporated into a shoulder strap of a backpack.

In certain embodiments, the hooks 1900 may be designed such that, when folded, the hooks 1900 substantially conform to the curvature or contour of the shoulder strap 1902. For example, FIG. 20 shows a side profile view of a hook 1900 integrated into a shoulder strap 1902. As shown by the dotted line, when folded upward, the hook 1900 substantially conforms to the contour of the shoulder strap 1902. The solid line, by contrast, may represent the hook 1900 when in an unfolded and usable position. In certain embodiments, when in the folded position, the hook 1900 may retain whatever item is hanging from the hook 1900 between the hook 1900 and the shoulder strap 1902, thereby preventing the item from falling off the hook 1900.

Figure 21:
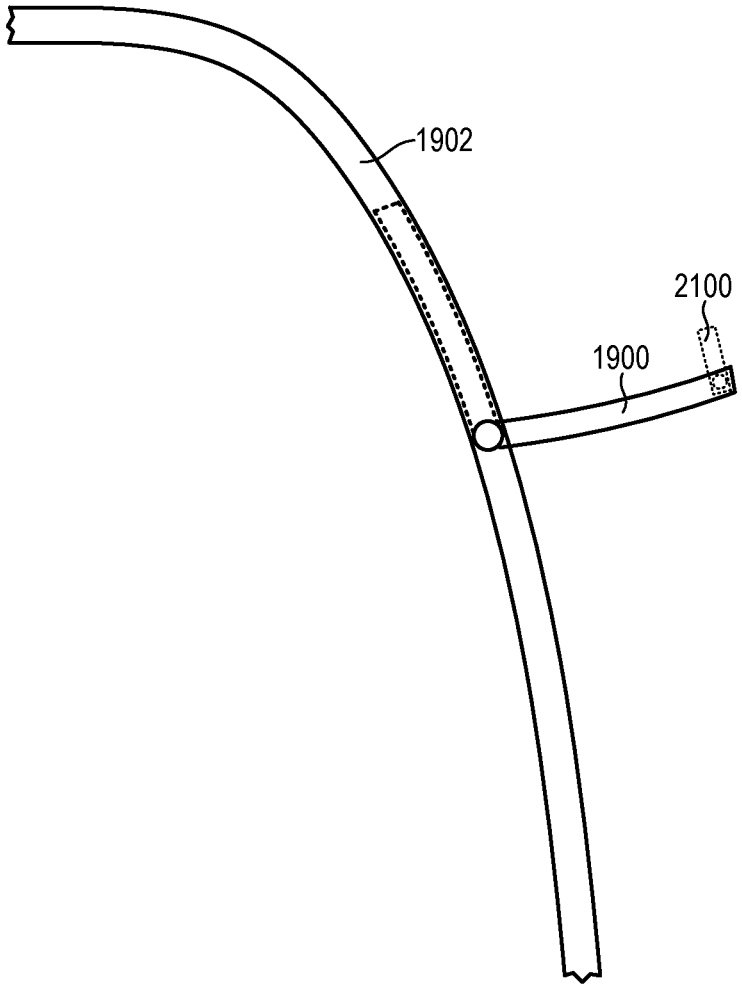
FIG. 21 is a side view showing yet another embodiment of a hook incorporated into a shoulder strap of a backpack.

FIG. 21 shows yet another embodiment of the hook 1900. In this example, the hook 1900 more closely conforms to the contour of the shoulder strap 1902. The dotted line represents the hook 1900 when in the folded or stowed position and the solid line represents the hook 1900 when folded down. In this embodiment, the hook 1900 is completely hidden or confined within the contours of the shoulder strap 1902. If needed, an end piece 2100 may be provided at an end of the hook 1900. This end piece 2100 may be rotated to keep items from falling off of the hook 1900.

In the above disclosure, reference has been made to the accompanying drawings which is shown by way of illustration specific implementations in which the disclosure may be practiced. It is understood that other implementations may be utilized and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

While various embodiments of the present disclosure have been described above, it should be understood that they have been presented by way of example only and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments, but should be defined only in accordance with the following claims and their equivalents. The foregoing description has been presented for the purposes of illustration and description. It is not intended to be exhaustive or to limit the disclosure to the precise form disclosed. Many modifications and variations are possible in light of the above teachings. Further, it should be noted that any or all of the aforementioned alternate implementations may be used in any combination desired to form additional hybrid implementations of the disclosure.

The invention claimed is:

1. A method for protecting a rifle and stabilizing the rifle when shooting, the method comprising:

providing a strap;

connecting a first end of the strap to a backpack;

connecting a second end of the strap to a rifle;

adjusting a length of the strap, such that when a user pulls the rifle over the shoulder from the backpack and holds the rifle in a shooting position, the strap slides over the user's shoulder from the backpack to the rifle and reduces a weight of the rifle in the user's arms when in the shooting position.

2. The method of claim 1, wherein the strap is an elastic strap.

3. The method of claim 1, wherein the rifle is normally carried on the backpack prior to being placed in the shooting position.

4. The method of claim 3, wherein the length of the strap prevents the rifle from hitting the ground in the event it falls from the backpack.

5. The method of claim 1, wherein adjusting the length of the strap comprises adjusting the length of the strap to maintain the rifle substantially level when in the shooting position.

6. The method of claim 1, wherein adjusting the length of the strap comprises adjusting the length of the strap to maintain a muzzle of the rifle pointed slightly upward when in the shooting position.

7. The method of claim 1, wherein adjusting the length of the strap comprises moving an adjustable slide on the strap.

8. The method of claim 1, wherein the first end of the strap comprises a clip to removably couple the strap to the backpack.

9. The method of claim 1, wherein the second end of the strap comprises a clip to removably couple the strap to the rifle.

10. The method of claim 1, wherein the strap pulls the rifle into the shoulder of the user when in the shooting position.

11. The method of claim 1, wherein a waist belt of the backpack assists in maintaining tension in the strap when the rifle is in the shooting position.

* * * * *